US005259937A

United States Patent [19]

Hatano et al.

[11] Patent Number: 5,259,937

[45] Date of Patent: Nov. 9, 1993

[54] PROCESS FOR FORMING COLORLESS CHROMATE COATING FILM ON BRIGHT ALUMINUM WHEEL

[75] Inventors: Norifumi Hatano; Akihiko Hasebe; Kazuyuki Oyama, all of Tokyo; Katsuya Yamamoto, Yokohama, all of Japan

[73] Assignees: Nihon Parkerizing Co. Ltd., Tokyo; Nissan Motor Co., Ltd., Yokohama, both of Japan

[21] Appl. No.: 991,426

[22] Filed: Dec. 16, 1992

[30] Foreign Application Priority Data

Dec. 27, 1991 [JP] Japan ..... 3-358254

[51] Int. Cl.[5] ..... C25D 5/00

[52] U.S. Cl. ..... 205/149; 205/196; 205/286; 205/319

[58] Field of Search ..... 205/149, 196, 286, 319

[56] References Cited

U.S. PATENT DOCUMENTS

| | | | |
|---|---|---|---|
| 3,475,295 | 10/1969 | Smith et al. | 205/319 |
| 3,479,162 | 11/1969 | Yanabu et al. | 205/319 |
| 3,943,040 | 3/1976 | Willson | 205/286 |
| 4,206,019 | 6/1980 | Classic | 205/286 |
| 4,432,845 | 2/1984 | Ogata et al. | 205/319 |
| 4,545,867 | 10/1985 | Ballarihi et al. | 205/196 |

FOREIGN PATENT DOCUMENTS

| | | | |
|---|---|---|---|
| 54-13431 | 1/1979 | Japan . | |
| 110896 | 6/1985 | Japan . | |
| 2-118099 | 5/1990 | Japan . | |
| 804723 | 2/1981 | U.S.S.R. | 205/149 |

*Primary Examiner*—John Niebling
*Assistant Examiner*—Kishor Mayekar
*Attorney, Agent, or Firm*—Armstrong, Westerman, Hattori, McLeland & Naughton

[57] ABSTRACT

A colorless chromate coating film is formed on a bright aluminum wheel by subjecting the surface of an aluminum wheel to a cathodic electrolytic treatment in an acidic aqueous solution containing not less than 2 g/l of hexavalent chromium ions, 20 to 2,000 ppm of sulfate ions, 10 to 400 ppm of fluorine (F) as fluoride and not less than 20 ppm of zirconium ions at a pH of 0.6 to 1.7 at a current density of 0.5 to 15 A/dm$^2$ for at least 30 seconds, thereby forming a coating film with a chromium coating amount of 50 to 250 mg/m$^2$.

6 Claims, 1 Drawing Sheet

PROCESS FOR FORMING COLORLESS CHROMATE COATING FILM ON BRIGHT ALUMINUM WHEEL

BACKGROUND OF THE INVENTION

The present invention relates to a process for pretreatment of an aluminum wheel prior to paint.

1. Prior Art

Anodic oxidation (Alumite process), metal coloring, and chemical conversion treatment (reactive chromate process, MBV process, boehmite process, etc.) are well known as processes for surface treatment of aluminum and aluminum alloys. In aluminum coating, reactive chromate treatment, non-chromate treatment (organometallic salt film, etc.), and film treatment by anodic oxidation are carried out as a pretreatment prior to the paint coating to improve the corrosion resistance and paint adhesiveness.

In case of a pretreatment for clear coating utilizing the brightness of aluminum wheels, films by non-chromate treatment (organometallic salt film) are not satisfactory in the corrosion resistance, and films by anodic oxidation have a good corrosion resistance, but its coating is so thick that the brightness is lost. That is, these treatments are not satisfactory as pretreatments for the clear finishing making highly use of the brightness of a base metal. Films by reactive chromate treatment have a good corrosion resistance, but when a colorless film appearance is required, the chromium coating amount (chromium amount in the coating) is limited to not more than 10 mg/m$^2$, and thus a filiform corrosion resistance is not satisfactory.

As described above, no such pretreatment processes that can give satisfactory corrosion resistance and adhesiveness after paint coating, while maintaining the brightness of aluminum wheels as a base material have been found yet.

SUMMARY OF THE INVENTION

An object of the present invention is to provide a pretreatment process for forming a pretreatment coating film having a good corrosion resistance (particularly resistance to filiform corrosion) and a good adhesiveness after paint coating, while maintaining the brightness of aluminum wheels as a base material.

As a result of extensive studies of a pretreatment process, the present inventors have found that a colorless chromate coating film that can attain the above-mentioned object of the present invention can be obtained by cathodic electrolytic treatment of aluminum wheels in an acidic aqueous solution containing hexavalent chromium ions, sulfate ions, fluorine (F) as fluoride and zirconium ions at specific concentrations, adjusted to a specific pH, and that the thus obtained film has a good resistance to filiform corrosion and a good adhesiveness after paint coating.

According to the present invention, there is provided a process for forming a colorless chromate coating film on an aluminum wheel, which comprises subjecting a surface of an aluminum wheel to a cathodic electrolytic treatment in an acidic aqueous solution containing not less than 2 g/l of hexavalent chromium ions, 20 to 2,000 ppm of sulfate ions, 10 to 400 ppm of fluorine (F) as fluoride and not less than 20 ppm of zirconium ions at a pH of 0.6 to 1.7 at a current density of 0.5 to 15 A/dm$^2$ for at least 30 seconds, thereby forming a coating film with a chromium coating amount of 50 to 250 mg/m$^2$.

DETAILED DESCRIPTION OF THE INVENTION

Figure 1:
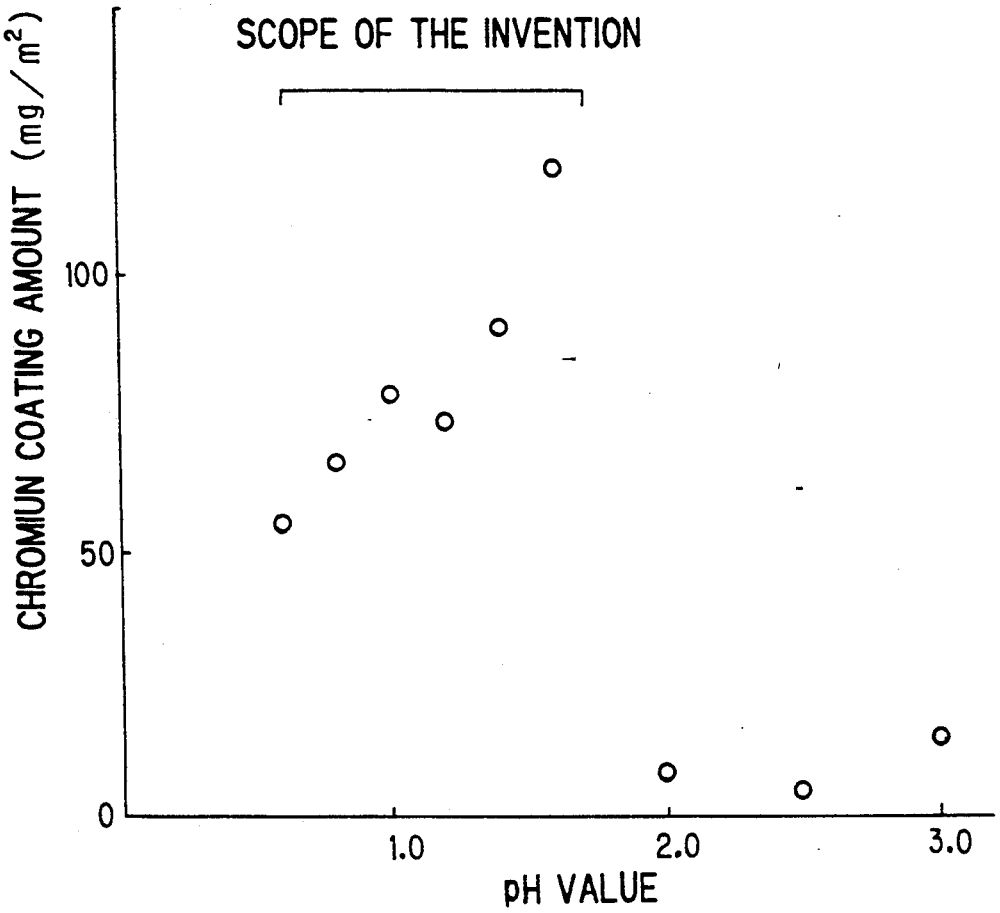
FIG. 1 shows a relationship between pH of an electrolytic solution and a chromium coating amount.

Individual components for an acidic aqueous solution as a pretreatment solution will be described below.

As a source for hexavalent chromium ions, chromic acid anhydride, alkali metal chromates, and alkali metal bichromates can be used, and at least one of these compounds can be used at a hexavalent chromium ion concentration of 2 to 50 g/l. Below 2 g/l, no chromate film having a good corrosion resistance can be obtained, whereas above 50 g/l the waste water treatment is an economically more burden, though there is no problem on the performance.

With progress of the electrolytic treatment, the quantity of trivalent chromium ions increases, but the concentration of trivalent chromium ions has less influences on the properties of a film in the present invention. Thus, it is not necessary to particularly limit the concentration of trivalent chromium ions.

As a source for sulfate ions, sulfuric acid and alkali metal sulfates can be used at a sulfate ion concentration of 20 to 2,000 ppm. Below 20 ppm, no colorless chromate coating film is formed, whereas above 2,000 ppm chromium coating amount is decreased and thus the corrosion resistance is unpreferably lowered.

Fluorine is present in the form of fluoride ions and/or complex fluoride ions, and as a source for the fluoride ions, hydrofluoric acid can be used. As a source for the complex fluoride ions, hydrosilicofluoric acid, hydrozircofluoric acid, hydroborofluoric acid, etc. can be used upon proper selection. Fluoride ion and/or complex fluoride ion concentration is 10 to 400 ppm in terms of fluoride (F). Below 10 ppm no chromate coating film having a good corrosion resistance after paint coating is formed, whereas above 400 ppm, the formation of chromate coating film by the electrolysis is suppressed, and thus a desired chromium coating amount is hard to obtain, and the resulting film is colored even at a relatively small chromium coating amount. Thus, the concentration of more than 400 ppm is not suitable for clear coating.

As a source for zirconium ions, hydrozircofluoric acid; sodium, potassium and ammonium salts of hydrozircofluoric acid; zirconium sulfate, etc. can be used at a zirconium ion concentration of 20 to 1,000 ppm. Below 20 ppm no improvement of filiform corrosion resistance is obtained, whereas above 1,000 ppm no better effect is obtained on the filiform corrosion resistance.

pH of the acidic aqueous solution as a pretreatment solution is limited to a range of 0.6 to 1.7. To control the pH, ammonium hydroxide, alkali metal hydroxides, alkali metal carbonates, chromic acid, sulfuric acid, and nitric acid can be added to the aqueous solution upon selection. At a pH below 0.6, there is no problem on the paint coating performance, but since the pH of the pretreatment solution increases during the cathodic electrolytic treatment it is necessary is adjust the pH from time to time in the commercial cathodic electrolytic treatment, and it is hard to maintain and control the pH within the desired range without frequent pH adjustment. At a pH above 1.7, the chromium coating amount is rapidly decreased and it is hard to obtain an appropriate chromium coating amount.

Temperature of the pretreatment solution is not particularly limited, but is preferably 30° to 60° C. Below 30° C., cooling is required for the temperature maintenance, because of heat release due to the electrolysis, whereas above 60° C. the properties of the resulting film are not largely changed, but the metal surface tends to partially dried and rinsing efficiency is lowered in the successive water rinsing step after the electrolytic treatment.

Electrolytic treatment is carried out on an aluminum wheel as a cathode, while using stainless steel, titanium, platinum, etc. as an anode. The conditions for the electrolytic treatment are an electrolytic current density of 0.5 to 15 A/dm$^2$ at the cathode. At a current density of less than 0.5 A/dm$^2$, it is hard to form a chromate film on the aluminum wheel, whereas above 15 A/dm$^2$ the film is colored, and resolution of the film occurs, and the desired colorless chromate coating film cannot be obtained.

At least 30 seconds are required for the electrolytic treatment. The electrolytic time is controlled to obtain a desired range of coating weight (chromium coating amount). There are many factors that change the coating weight (chromium coating amount). In the present invention, even if the concentrations of the individual components, pH and temperature of the pre-treatment solution and the current density, etc. are set to desirable conditions for the present invention, a desired chromium coating amount can be controlled by changing the electrolytic time. Furthermore, the chromium coating amount can be also controlled by changing the current density, while fixing the electrolytic time.

In the present invention a preferable chromium coating amount is 50 to 250 mg/m$^2$. Below 50 mg/m$^2$, the corrosion resistance, particularly filiform corrosion resistance, after paint coating is poor, whereas above 250 mg/m$^2$ the resulting chromate film is colored and the chromium coating amount above 250 mg/m$^2$ is not suitable for clear finish coating. However, in case of color coating, a coverage amount even above 250 mg/m$^2$ is applicable.

Furthermore, a colorless chromate coating film having a relatively large thickness can be formed by adding to the present acid aqueous pretreatment solution colloidal silica, dry-process silica, alkali metal silicates.

The aluminum wheels subjected to the cathodic electrolytic treatment according to the present invention are used as substrates for paint coating after water rinsing and drying. If required, a post-treatment by an aqueous chromate solution and organic compound as generally used can be carried out between the water rinsing and the drying. cl DESCRIPTION OF THE PREFERRED EMBODIMENTS The present invention will be described in detail below, referring to Examples and Comparative Examples, where test pieces prepared by polishing the surfaces of aluminum alloy plates (JIS AC4C; sizes: 70 mm×150 mm×7 mm) were subjected to alkali cleaning to clean the surfaces and then to electrolytic treatment.

Examples 1 to 6

An acidic aqueous solution containing 20 g/l of hexavalent chromium ions from chromic acid anhydride, 400 ppm of sulfate ions from sulfuric acid, and 100 ppm of fluorine (F) and 80 ppm of zirconium ions from hydrozircofluoric acid was subjected to pH adjustment with ammonium hydroxide under the conditions shown in Table 1 (pH 0.6 for Example 1 to pH 1.6 for Example 6). Test pieces were dipped in the acidic aqueous solution as a cathode, and electrolytic treatment was carried out at a current density of 2 A/dm$^2$ at the cathode for 60 seconds, while keeping the aqueous solution at 40° C. by circulating the solution. After the electrolytic treatment, the test pieces were taken out of the solution, rinsed with water and then with deionized water, and then dried in a drying oven at 100° C. for 5 minutes. Then, the test pieces were coated with a thermo-setting acrylic resin clear to a film thickness of 30 μm, baked at 140° C. for 30 minutes. Then, the coated test pieces were subjected to corrosion resistance tests (filiform corrosion test and salt spray test). The results are shown in Table 1. Relationship between the pH of the acidic aqueous solution and the chromium coating amount is shown in FIG. 1.

Comparative Examples 1 to 3

An acid aqueous solution containing 20 g/l of hexavalent chromium ions from chromic acid anhydride, 400 ppm of sulfate ions from sulfuric acid, and 100 ppm of fluorine (F) and 80 ppm of zirconium ions from hydrozircofluoric acid was subjected to pH adjustment with ammonium hydroxide under conditions shown in Table 1 (pH 2.0 for Comparative Example 1 to pH 3.0 for Comparative Example 3). Then the test pieces were subjected to electrolytic treatment, paint coating and corrosion resistance tests in the same manner as in Example 1. Results are shown in Table 1.

Example 7

An acidic aqueous solution containing 5 g/l of hexavalent chromium ions from chromic acid anhydride, 100 ppm of sulfate ions from sulfuric acid and 30 ppm of fluorine (F) and 24 ppm of zirconium ions from hydrozircofluoric acid was subjected to pH adjustment with ammonium hydroxide to pH 1.0. Then the test pieces were subjected to electrolytic treatment, paint coating and corrosion tests in the same manner as in Example 1. The results are shown in Table 1.

Example 8

An acidic aqueous solution containing 50 g/l of hexavalent chromium ions from chromic acid anhydride, 1 g/l of sulfate ions from sulfuric acid, and 400 ppm of fluorine (F) and 320 ppm of zirconium ions from hydrozircofluoric acid was subjected to pH adjustment with ammonium hydroxide to pH 1.0. Then the test pieces were subjected to electrolytic treatment, paint coating and corrosion resistance tests in the same manner as in Example 1. The results are shown in Table 1.

Example 9

An acidic aqueous solution containing 20 g/l of hexavalent chromium ions from chromic acid anhydride, 400 ppm of sulfate ions from sulfuric acid 30 ppm of fluorine (F) and 24 ppm of zirconium ions from hydrozircofluoric acid, and 2 g/l of silica sol in terms of solid concentration of colloidal silica (Snowtex O, made by Nissan Kagaku Kogyo K.K., Japan) was subjected to pH adjustment with ammonium hydroxide to pH 1.0. Then the test pieces were subjected to electrolytic treatment, paint coating and corrosion resistance tests in the same manner as in Example 1. The results are shown in Table 2.

Example 10

An acidic aqueous solution containing 20 g/l of hexavalent chromium ions from chromic acid anhydride, 400 ppm of sulfate ions from sulfuric acid, and 110 ppm of fluorine (F) and 90 ppm of zirconium ions from hydrozircofluoric acid was subjected to pH adjustment with ammonium hydroxide to pH 1.0. Then, the test pieces were dipped in the acidic aqueous solution as a cathode, and subjected to electrolytic treatment at a current density of 10 A/dm$^2$ at the cathode for 30 seconds and then subjected to paint coating and corrosion resistance tests in the same manner as in Example 1. The results are shown in Table 2.

Comparative Example 4

An acidic aqueous solution containing 20 g/l of hexavalent chromium ions from chromic acid anhydride, 400 ppm of sulfate ions from sulfuric acid, and 110 ppm of fluorine (F) and 90 ppm of zirconium ions from hydrozircofluoric acid was subjected to pH adjustment with ammonium hydroxide to pH 1.0. Then, the test pieces were dipped in the acidic aqueous solution as a cathode and then subjected to electrolytic treatment at a current density of 20 A/dm$^2$ at the cathode for 30 seconds, and then subjected to paint coating and corrosion resistance tests in the same manner as in Example 1. The results are shown in Table 2.

Comparative Example 5

An acidic aqueous solution containing 20 g/l of hexavalent chromium ions from chromic acid anhydride, 400 ppm of sulfate ions from sulfuric acid, and 110 ppm of fluorine (F) and 90 ppm of zirconium ions from hydrozircofluoric acid was subjected to pH adjustment with ammonium hydroxide to pH 1.0, and the test pieces were dipped in the acidic aqueous solution as a cathode and subjected to electrolytic treatment at a current density of 30 A/dm$^2$ at the cathode for 30 seconds and then to paint coating and corrosion resistance tests in the same manner as in Example 1. The results are shown in Table 2.

Comparative Example 6

The test pieces were dipped as a cathode in an acid aqueous solution containing 10 g/l of hexavalent chromium ions from chromic acid anhydride, 15 g/l of phosphate ions from phosphoric acid and 3 g/l of sulfate ions from sodium sulfate and subjected to electrolytic treatment at a current density of 0.5 A/dm$^2$ for 3 minutes and then to paint coating and corrosion tests in the same manner as in Example 1. The results are shown in Table 2.

Comparative Example 7

The test pieces were subjected to alkali cleaning to clean the surfaces and then to reactive chromate treatment with Alchrom® 3703, made by Nihon Parkerizing Co., Ltd., Japan, rinsing with water and then with deionized water, and drying in a drying oven at 100° C. for 5 minutes. Then, the test pieces were coated with a thermo-setting acrylic resin clear lacquer to a film thickness of 30 μm, baked at 140° C. for 30 minutes and then subjected to corrosion resistance tests (filiform corrosion test and salt spray test). The results are shown in Table 2.

Comparative Example 8

The test pieces were subjected to alkali cleaning, caustic soda etching and desmutting to clean the surfaces, and then to an ordinary Almite treatment (anodic oxidation treatment under such conditions as 180 g/l of sulfuric acid; 5 g/l of dissolved aluminum; bath temperature: 25° C.; current density: 1 A/dm$^2$; and treating time: 15 minutes), rinsing with water and then with deionized water and drying in a drying oven at 100° C. for 5 minutes. Then, the test pieces were coated with a thermo-setting acrylic resin clear lacquer to a thickness of 30 μm and baked at 140° C. for 30 minutes. Then, the test pieces were subjected to corrosion resistance test (filiform corrosion test and salt spray test). The results are shown in Table 2.

Comparative Example 9

The test pieces were subjected to alkali cleaning to clean the surface and then dried in a drying oven at 100° C. for 5 minutes. Then, the test pieces were coated with a thermo-setting acrylic resin clear lacquer to a thickness of 30 μm, baked at 140° C. for 30 minutes. The test pieces were subjected to corrosion resistance tests (filiform corrosion test and salt spray test). The results are shown in Table 2.

Evaluation test procedures

1 ) Film appearance

Color differences were measured by a color difference meter according to JIS Z8730, using an untreated test piece as a standard and evaluated on the basis of the following ranking:

◎ Color difference: 0–3.2 (No coloration was observed visually)

Color difference: 3.2–6.5 (Slight coloration was observed)

Δ Color difference: 6.5–13 (Distinct coloration was observed)

x Color difference: more than 13 (strong coloration was observed)

2) Chromium coating amount:

Determined by a fluorescent X-ray analyzer.

3) Filiform corrosion test:

Paint-coated test pieces were scribed by an NT cutter penetrate to the substrates, dipped in a corrosive solution (mixture of 1N-hydrochloric acid and 5% hydrogen peroxide) for one minute, and air dried. After 24 hours, the test pieces were subjected to a humidity test at a temperature of 50° C. and a humidity of 80% for 1,000 hours, and then the length of filiform corrosion developed from the scribe was measured.

◎ Maximum length of filiform corrosion: within 2 mm

Maximum length of filiform corrosion: within 3 mm

Δ Maximum length of filiform corrosion: within 5 mm x Maximum length of filiform corrosion: more than 5 mm 4) Salt spray test (SST):

The paint coated test pieces were scribed with an NT cutter penetrate to the substrates and subjected to salt spray test for 1,000 hours according to JIS Z2371 and corrosion creepage developed from the scribe was determined.

◎ Maximum width of creepage: within 1 mm

Maximum width of creepage: within 2 mm

Δ Maximum width of creepage: within 3 mm x Maximum width of creepage: more than 3 mm

TABLE 1

| | Concentration (g/l) | | | | | Chromium coating amount | Appearance | Corrosion resistance after coating | |
|---|---|---|---|---|---|---|---|---|---|
| | $Cr^{6+}$ | $SO_4^{2-}$ | F | $Zr^{4+}$ | pH | ($mg/m^2$) | | Filiform corrosion resistance | SST |
| Ex. 1 | 20 | 0.4 | 0.1 | 0.08 | 0.6 | 56 | ◎ | ○ | ◎ |
| 2 | | | | | 0.8 | 67 | ◎ | ○ | ◎ |
| 3 | | | | | 1.0 | 80 | ◎ | ○ | ◎ |
| 4 | | | | | 1.2 | 75 | ◎ | ○ | ◎ |
| 5 | | | | | 1.4 | 92 | ◎ | ◎ | ◎ |
| 6 | | | | | 1.6 | 121 | ◎ | ◎ | ◎ |
| Comp. Ex. 1 | 20 | 0.4 | 0.1 | 0.08 | 2.0 | 10 | ○ | Δ | ○ |
| 2 | | | | | 2.5 | 6 | ○ | Δ | ○ |
| 3 | | | | | 3.0 | 16 | Δ | Δ | ○ |
| Ex. 7 | 5 | 0.1 | 0.03 | 0.024 | 1.0 | 65 | ◎ | ○ | ◎ |
| Ex. 8 | 50 | 1 | 0.4 | 0.32 | 1.0 | 88 | ○ | ◎ | ◎ |

TABLE 2

| | Concentration (g/l) | | | | | Current density | Chromium coating amount | Appearance | Corrosion resistance after paint coating | |
|---|---|---|---|---|---|---|---|---|---|---|
| | $Cr^{6+}$ | $SO_4^{2-}$ | F | $Zr^{4+}$ | Silica | $A/dm^2$ | ($mg/m^2$) | | Filiform corrosion resistance | SST |
| Ex. 9 | 20 | 0.4 | 0.03 | 0.024 | 2 | 2 | 138 | ◎ | ◎ | ◎ |
| Ex. 10 | 20 | 0.4 | 0.11 | 0.09 | 0 | 10 | 188 | ○ | ◎ | ◎ |
| Comp. Ex. 4 | 20 | 0.4 | 0.11 | 0.09 | 0 | 20 | 290 | Δ | ○ | ◎ |
| Comp. Ex. 5 | 20 | 0.4 | 0.11 | 0.09 | 0 | 30 | 36 | x | Δ | ○ |
| Comp. Ex. 6 | 10 | 3 | 0 | 0 | 0 | 3 | 220 | x | Δ | ○ |
| Comp. Ex. 7 | Reactive chromate treatment (Alchrom 3703) | | | | | | 10 | ◎ | Δ | ○ |
| Comp. Ex. 8 | Almite treatment | | | | | | 0 | x | ◎ | ◎ |
| Comp. Ex. 9 | Only alkali defatting | | | | | | 0 | ◎ | x | x |

According to the present invention, a colorless chromate coating film having a good corrosion resistance and a good adhesiveness after paint coating while retaining the brightness of aluminum wheels as a base material can be formed, and the corrosion resistance, particularly filiform corrosion resistance, which has been so far a serious problem, can be improved as a pretreatment prior to clear finishing.

What is claimed is:

1. A process for forming a colorless chromate coating film on an aluminum wheel, which comprises subjecting a surface of the aluminum wheel to a cathodic electrolytic treatment in an acidic aqueous solution containing not less than 2 g/l of hexavalent chromium ions, 20 to 2,000 ppm of sulfate ions, 10 to 400 ppm of fluorine (F) as fluoride and not less than 20 ppm of zirconium ions at a pH of 0.6 to 1.7 at a current density of 0.5 to 15 $A/dm^2$ for at least 30 seconds, thereby forming a coating film with a chromium coating amount of 50 to 250 $mg/m^2$.

2. A process according to claim 1, wherein the hexavalent chromium ions are ions from at least one member selected from the group consisting of chromic acid anhydride, alkali chromates and alkali bichromates.

3. A process according to claim 1, wherein the sulfate ions are ions selected from the groups consisting of sulfuric acid or alkali metal sulfates.

4. A process according to claim 1, wherein the fluorine (F) are F in the form of one member selected from the group consisting of hydrofluoric acid, hydrozircofluoric acid, hydrosilicofluoric acid and hydroborofluoric acid.

5. A process according to claim 1, wherein the zirconium ions are ions from at least one member selected from the group consisting of hydrozircofluoric acid, sodium, potassium and ammonium salts of hydrozircofluoric acid and zirconium sulfate.

6. A process according to claim 1, wherein the acidic aqueous solution further contains colloidal silica, dry process silica or alkali metal silicates.

* * * * *